United States Patent [19]

Haslau

[11] 4,183,002

[45] Jan. 8, 1980

[54] WINDING STRUCTURE

[75] Inventor: Horst E. Haslau, Indianapolis, Ind.

[73] Assignee: RCA Corporation, New York, N.Y.

[21] Appl. No.: 909,627

[22] Filed: May 26, 1978

[51] Int. Cl.[2] ..... H01F 15/10; H01F 27/30

[52] U.S. Cl. ..... 336/192; 336/198

[58] Field of Search ..... 336/198, 208, 192, 170; 310/71

[56] References Cited

U.S. PATENT DOCUMENTS

| | | | |
|---|---|---|---|
| 1,142,027 | 6/1915 | DaCosta | 336/192 |
| 2,753,530 | 7/1956 | Horvath | 336/192 X |
| 3,605,055 | 9/1971 | Grady | 336/192 X |
| 4,109,224 | 8/1978 | Liqutaud | 336/192 |
| 4,151,500 | 4/1979 | Malerba et al. | 336/192 |

*Primary Examiner*—Thomas J. Kozma

*Attorney, Agent, or Firm*—Eugene M. Whitacre; Paul J. Rasmussen; Joseph J. Laks

[57] ABSTRACT

A plurality of winding units are each wound in winding channels formed in a bobbin. Each of the winding units include start and finish location conductor portions or termination leads or segments located at predetermined longitudinal and angular positions relative to the longitudinal axis of the bobbin. Longitudinally extensive connecting conductors are located inward of the bobbin outer surface. A plurality of passageways are formed in shoulders or partitions separating the winding channels. These passageways provide access from the outer surface to the connecting conductors. Guide tracks connect the winding channels with the passageways and guide the conductor wire of a winding unit from its winding channel to a passageway for positioning a start or finish conductor portion of the winding unit over the passageway. A radial extension of the longitudinal connecting conductor extends into the passageway and provides electrical interconnection between the connecting conductor and the start or finish conductor portion of the winding unit.

11 Claims, 19 Drawing Figures

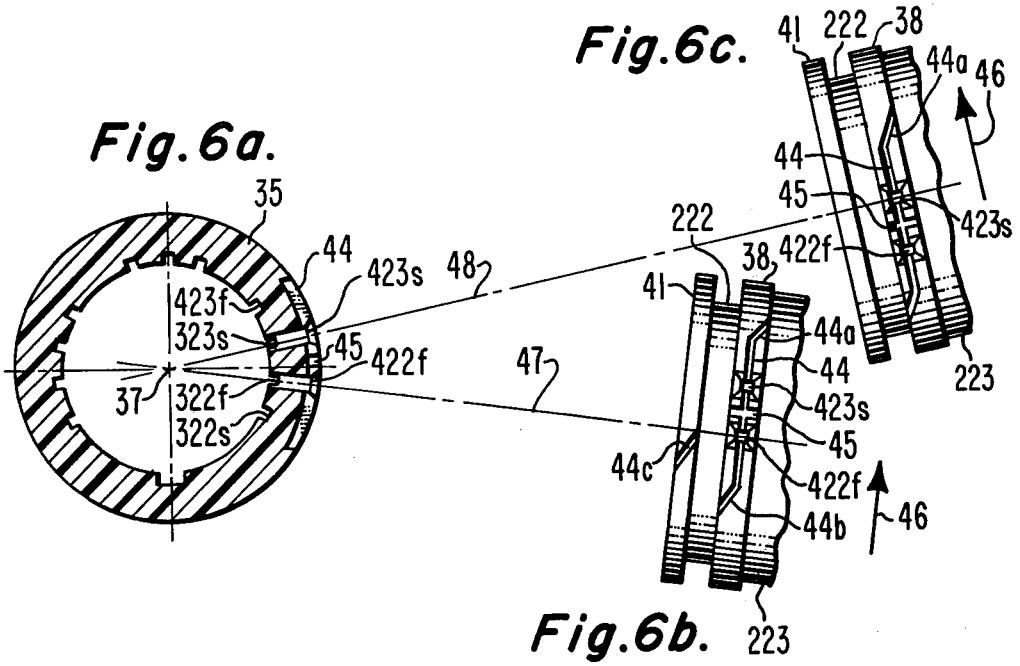
Fig.6a.
35
44
423s
48
423f
323s
45
422f
37
322f
322s
47
Fig.6c.
41
222
38
44a
46
44
45
423s
222
38
422f
41
44a
44
423s
45
44c
422f
44b
46
223
223
Fig.6b.
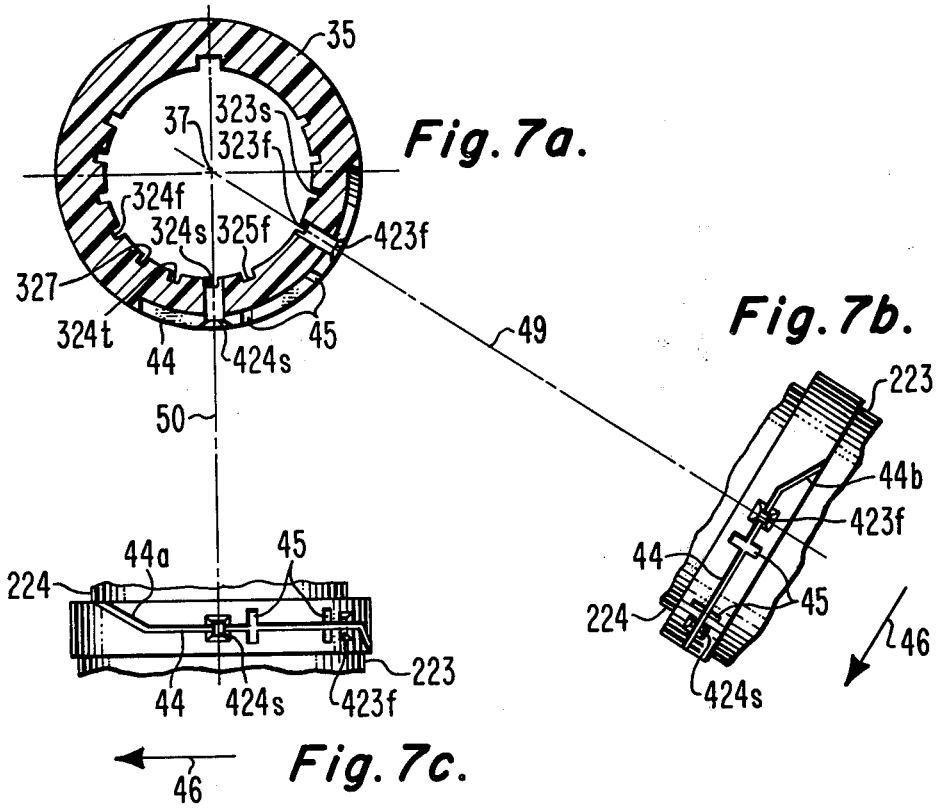
35
37
323s
323f
Fig.7a.
324f
324s
325f
423f
327
324t
44
424s
45
49
Fig.7b.
223
50
44b
423f
44a
45
44
224
45
224
46
223
44
424s
423f
424s
46
Fig.7c.

Fig.8f.
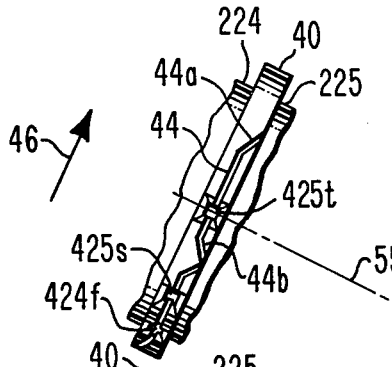
Fig.8a.
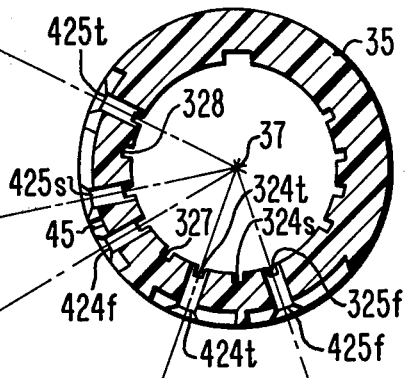
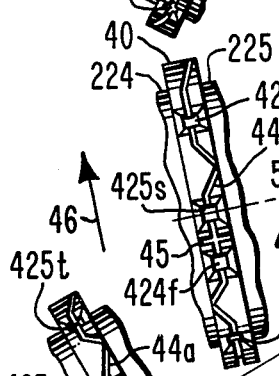
Fig.8e.
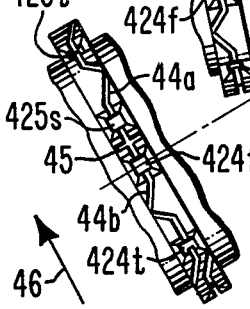
Fig.8d.
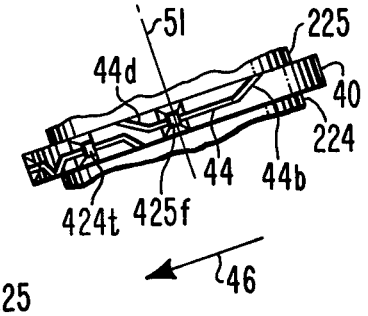
Fig.8b.
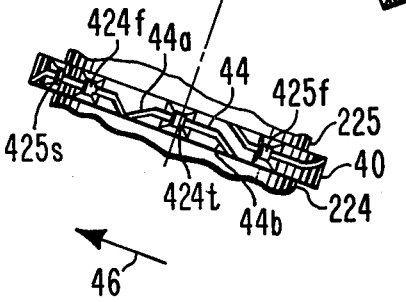
Fig.8c.

WINDING STRUCTURE

BACKGROUND OF THE INVENTION

This invention relates to transformer and wound coil structures.

Many transformers include a primary winding unit and a plurality of secondary winding units, each winding unit wound on one or more bobbins. Each winding unit will include a start and finish conductor portion and may also include intermediate tap points.

Conventional techniques for winding a plurality of such units on a bobbin necessitate multiple stoppages of the winding process in order to initiate termination procedures at each of the start, finish, or tap locations. Such techniques increase considerably the time required to complete winding all of the units on a bobbin. It is desirable to design a winding structure having a plurality of winding units that can be wound in one operation without stoppage until they are all completely wound.

SUMMARY OF THE INVENTION

A winding structure comprises at least one winding channel situated adjacent an outer surface of a bobbin for winding at least one conductor winding unit about the winding channel. The winding unit includes at least one conductor termination segment located at a predetermined longitudinal position along a longitudinal axis of the bobbin and at a predetermined angular position about the longitudinal axis. At least one longitudinal connecting conductor is located inwardly of the outer surface and traverses at least a portion of the bobbin in a direction generally along the longitudinal axis. At least one passageway is located in a winding channel shoulder adjacent the predetermined angular and longitudinal positions and provides access to the longitudinal connecting conductor. At least one guide track is located in the shoulder and connects the passageway to the winding channel for guiding a conductor portion of the winding unit from the winding channel to the passageway for emplacing the conductor termination segment. An electrical interconnecting structure is located in the passageway and provides electrical connection between the conductor termination segment and the longitudinal connecting conductor.

Figure 2:
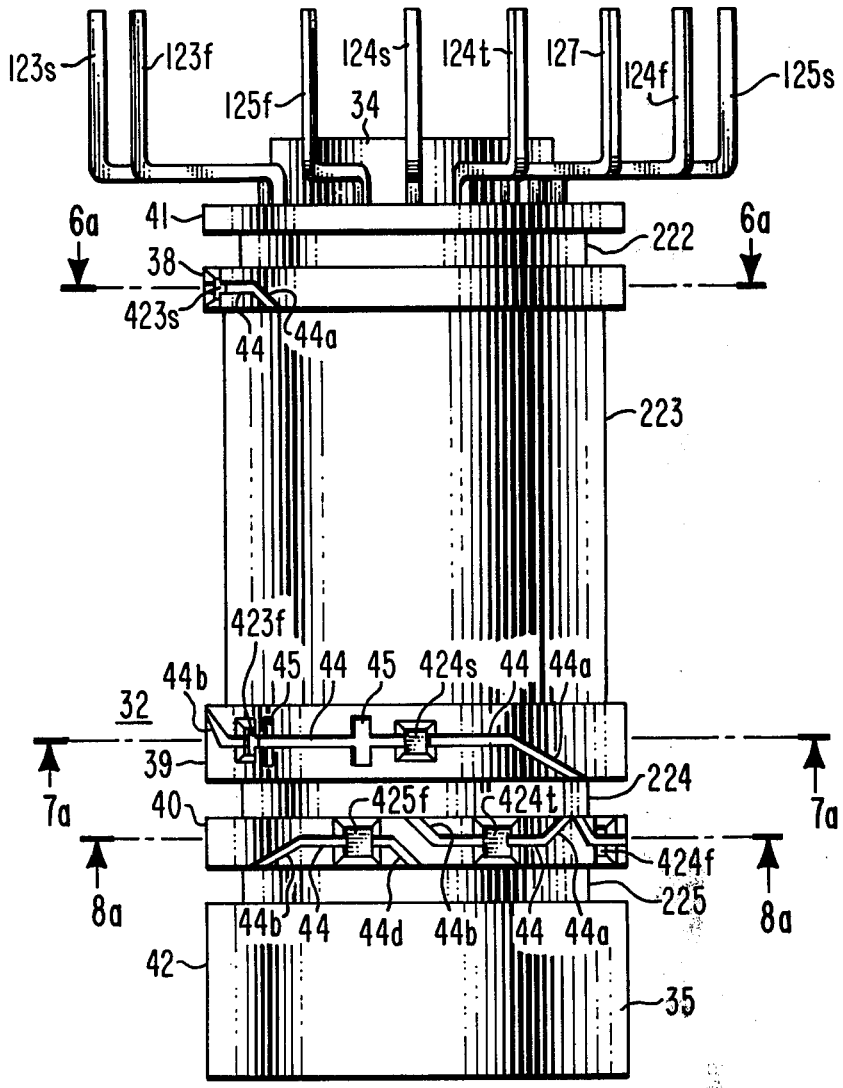
FIG. 2 illustrates a top elevation view of a primary assembly structure embodying the invention.
Figure 9:
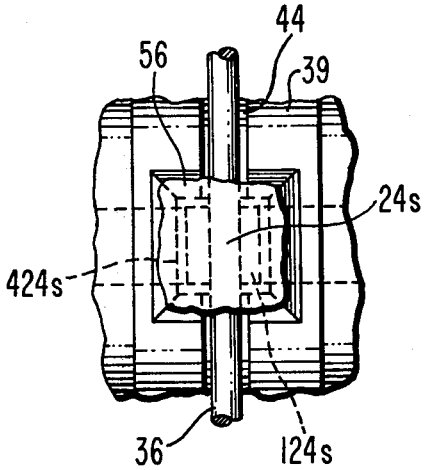
Figure 10:
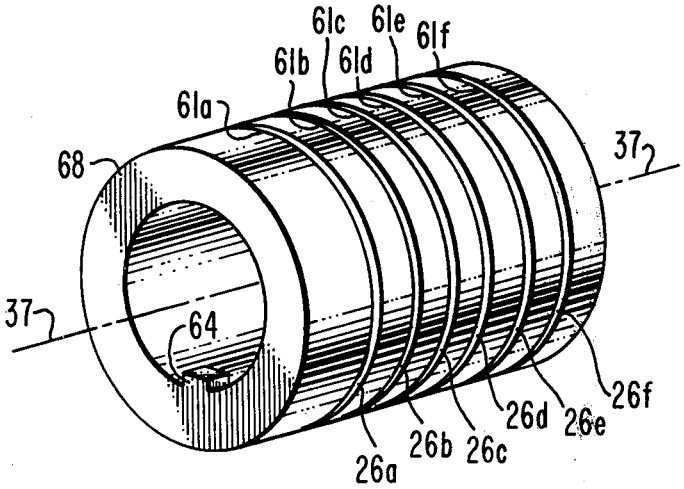

FIGS. *6a–6c* illustrate a cross-sectional view through a cross-section of the outer bobbin of FIG. 2 and face views along selected viewing axes in the vicinity of the cross-sectional plane;

FIGS. *7a–7c* illustrate a cross-sectional view through another cross-section of the outer bobbin of FIG. 2 and face views along selected viewing axes in the vicinity of the cross-sectional plane;

FIGS. *8a–8f* illustrate a cross-sectional view through a still other cross-section of the outer bobbin of FIG. 2 and face views along selected viewing axes in the vicinity of the cross-sectional plane;

FIG. 9 illustrates a face view of a wound primary assembly in the vicinity of a start location conductor portion of a selected winding unit; and FIG. 10 illustrates a high voltage assembly structure.

DESCRIPTION OF THE INVENTION

Figure 1:
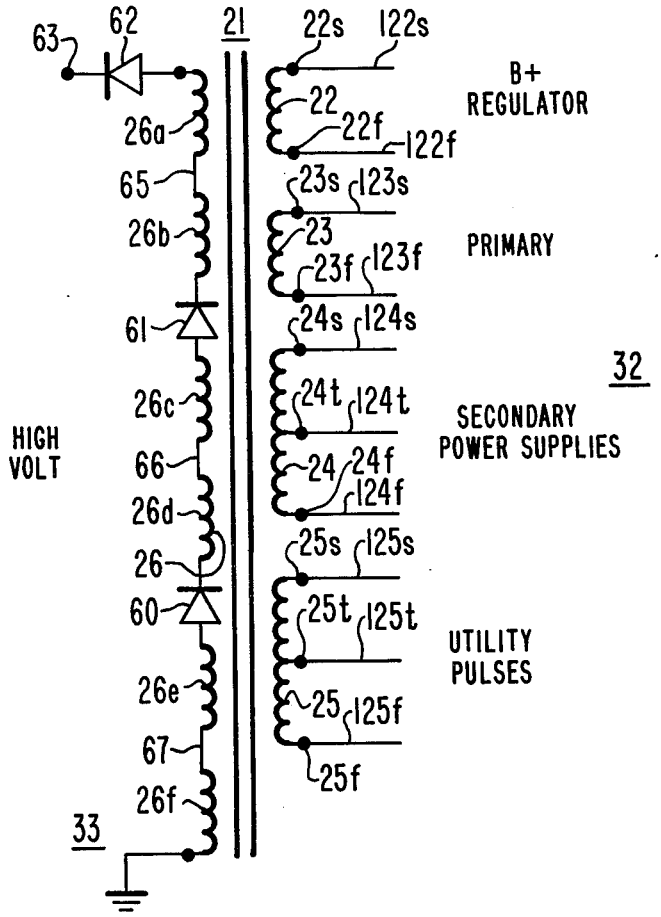
FIG. 1 illustrates an electrical schematic of a winding structure including primary and high voltage assemblies.

Illustrated in FIG. 1 is a typical electrical schematic diagram of a horizontal output or flyback transformer 21 of a television receiver. A typical primary assembly 32 associated with the primary winding of the transformer comprises four winding units 22–25, each with respective start locations **22*s*–25*s* in the assembly and finish locations or termination leads or segments 22*f*–25*f*. Winding units 24 and 25 also include tap locations 24*t* and 25*t*. To electrically connect the start, finish, and tap location conductor termination segments of the winding units with other television receiver circuitry, connecting conductors 122*s*–125*s*, 122*f*–125*f*, 124*t* and 125*t*** are provided.

Winding unit 23 ilustratively is designated as the primary winding and is typically coupled to the horizontal deflection circuitry and magnetically coupled to a high voltage secondary winding 26 of a high voltage assembly 33 of flyback transformer 21. High voltage winding 26 may comprise a single winding unit or a plurality of winding units **26*a*–26*f* interconnected by appropriately poled diodes 60 and 61 and conductors 65–67. A diode 62 couples one terminal of winding unit 26*a* to an ultor terminal 63**.

Winding unit 22 illustratively may provide a switching regulator B+ power supply circuit, not shown, with flyback pulses to control the conduction angle of the regulator switch. Such type regulator is described in U.S. Pat. No. 3,832,595 of W. F. W. Dietz. Winding unit 24 may function as a source of AC voltage for secondary power supplies for providing operating voltages for the various receiver circuitry. Winding unit 25 may provide horizontal retrace utility pulses for such functions as synchronizing the horizontal oscillator and blanking the kinescope during horizontal retrace.

The total number of conductor turns wound around the core may typically number about 125 turns distributed in a predetermined manner among the winding units of primary assembly 32. The winding units may typically be wound on a bobbin type coil form using a flyer type coil winding machine. Conductor wire from a spool of wire is guided to a wire guidance system, such as a flyer winding head. The flyer revolves around the longitudinal axis of the bobbin in a manner which will emplace the conductor turns on the bobbin. Emplacement may alternatively be accomplished by a wire guidance system that provides for rotation of the bobbin rather than revolution of a flyer.

The flyer or bobbin is also indexed in a predetermined manner in a direction parallel to the central longitudinal axis of the bobbin to emplace or wind the conductor turns along the length of the bobbin. Thus, the start location **22*s* of winding unit 22 of FIG. 1, for example, may be located at one end of the bobbin, while the finish location 25*f* of winding unit 25** may be located at the other end.

Conventionally, during winding, when the flyer has indexed to the longitudinal location of an intermediate winding unit start or finish lead or termination segment, such as location 23*f* or 24*s*, the revolving and indexing of the flyer is stopped. The machine operator then performs the required termination operations to provide for the finish termination of winding unit 23 and the start termination of winding unit 24. For example, when location 23*f* is reached, the winding is stopped. Adhesive tape is placed over the wire to provide a pivot point for the wire. An insulating material is placed over the already wound conductor turns. And the bobbin or flyer is indexed longitudinally, thereby playing out conductor wire over the insulating material until one end of the bobbin is reached. Termination to the rest of the circuits is then accomplished at this end.

Thus, at each intermediate start and finish location, the winding operation must be stopped to permit the operator to perform the required termination steps. Such winding stoppages are relatively costly and represent inefficient utilization of manpower and of relatively expensive winding machinery.

Figure 3:
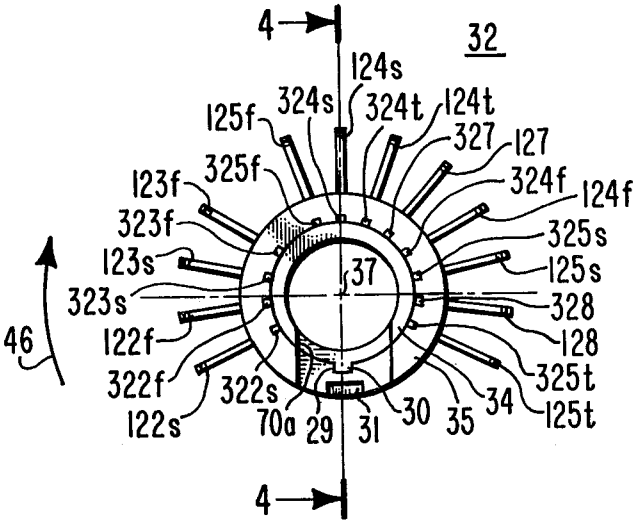
FIG. 3 illustrates an end view of the structure of FIG. 2.
Figure 4:
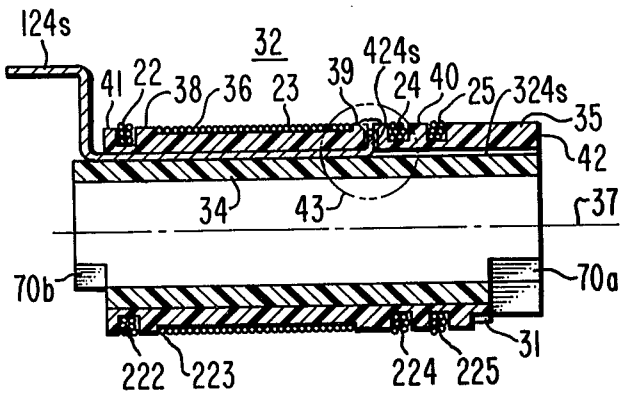
FIG. 4 illustrates a side elevation view through a cross-section of FIG. 3 and also includes conductor wire wound around the assembly.

The winding structure of FIGS. 2–4 of the primary assembly 32 embodying the invention is capable of being wound automatically by a flyer type coil winding machine in one continuous operation without the necessity of stoppages for start or finish termination operation. FIG. 2 illustrates a top elevation view of a winding structure without the conductor turns emplaced. FIG. 3 illustrates an end view; whereas, FIG. 4 illustrates a left elevation cross-sectional view with conductor turns 36 already having been emplaced.

With reference to FIGS. 2–4, assembly 32 comprises a hollow, generally cylindrical inner bobbin 34 and a hollow, generally cylindrical outer bobbin 35 located over inner bobbin 34, both bobbins with a common central longitudinal axis 37. The outer bobbin serves as the winding form around which are emplaced the conductor turns 36 of the various winding units 22–25.

For each winding unit 22–25, corresponding winding channels 222–225 are formed in the outer bobbin 35, into which channels the conductor turns of the winding units are emplaced. Separating each of the channels are intermediate partitions or shoulders 38–40. At either end of the bobbin 35 are located end walls 41 and 42, respectively.

As illustrated in FIGS. 3 and 4, longitudinal grooves 322*s*–325*s*, 322*f*–325*f*, 324*t*, 325*t*, 327, and 328 are formed inwardly of the outer surface of outer bobbin 35 along the inner surface of the outer bobbin. The grooves are angularly separated about the central longitudinal axis 37. Within the grooves are located respective longitudinally extensive connecting conductors 122*s*–125*s*, 122*f*–125*f*, 124*t*, and 125*t*, corresponding to the connecting conductors schematically illustrated in FIG. 1. The conductors function to electrically connect the start, finish, and tap locations or conductor termination segments of winding units 22–25 with other electrical circuits. Thus, the angular location about the longitudinal axis of each groove and connecting conductor corresponds to that of the angular location of the associated start, finish, or tap location of a winding unit.

Each connecting conductor may be of square cross-section and extend longitudinally in a first direction beyond end wall 41, as illustrated for the connecting conductor 124*s* of FIG. 4. Once beyond end wall 41, each connecting conductor is bent into an L-shape. Such shape facilitates insertion of the primary assembly into the holes of a printed circuit board for electrically connecting the assembly to the other television receiver circuitry.

As mentioned previously, the angular positions of the start, finish, or tap locations of a winding unit are the same as the corresponding connecting conductors. With reference to a typical winding unit 24 by way of example, the longitudinal position of the start location of winding unit 24 is in partition 39, separating the winding channels 223 and 224 of the adjacent winding units 23 and 24.

To provide for electrical connection between the start location conductor portion 24*s* and its associated longitudinal connecting conductor 124*s*, a hole or passageway 424*s* is introduced in partition 39 extending radially from the outer surface of bobbin 35 to the groove 324*s*. Connecting conductor 124*s* extends longitudinally from end wall 41 until the longitudinal position of the start location 24*s* is reached. The connecting conductor then bends outwardly in the radial direction through passageway 424*s* until the starting location conductor portion 24*s* is reached.

A guide track or guide channel 44 is formed in the partition 39 to enable the conductor wire of winding unit 24 to traverse partition 39 from the location of passageway 424*s* associated with start location portion 24*s* to the location of winding channel 224 of the conductor turns of winding unit 24. As illustrated in FIG. 2, guide track 44 traverses over passageway 424*s* in an oblique direction generally transverse to the longitudinal central axis 37. After traversing over the passageway, a winding channel entry portion 44*a* of guide track 44 continues to traverse the partition 39 but at a relatively shallow oblique angle to the transverse direction until reaching the end of partition 39 and the beginning of winding channel 224. Thus, for each of the start location conductor portions of each of the winding units, other than the first winding unit 22, there is associated a guide track over a corresponding passageway.

Similarly, associated with the finish location conductor portions, illustratively finish location 23*f* of FIG. 2, of each of the winding units is a guide track 44 over the corresponding passageway 423*f*. The guide track includes an obliquely directed exit portion 44*b* for traversing from the winding channel 223 of winding unit 23 through partition 39 to passageway 423*f* associated with finish location conductor portion 23*f*.

Connecting the passageway associated with the finish location of a given winding unit (in FIG. 2, illustratively passageway 423*f* of winding unit 23) with the passageway associated with the starting location of the next subsequent winding unit (passageway 424*s* of winding unit 24) is a continuation of guide track 44. Longitudinally directed depressions or cutting slits 45 are made in the guide track 44 adjacent the passageways of each of the start and finish locations of most of the winding units for purposes to be later described.

Electrical connection between a tap location of a winding unit and its corresponding longitudinal connecting conductor may also be obtained using guide tracks located over corresponding passageways. As illustrated in FIG. 2, a passageway 424*t* is formed in partition 40 at the angular and longitudinal position of the tap location conductor portion 24*t* of winding unit 24. A number of conductor turns of winding unit 24 are first wound in winding channel 224. Then, upon reaching the exit portion 44*b*, guide track 44 guides the conductor wire from winding channel 224 into partition 40.

Guide track 44 then guides the wire over passageway 424*t*. The entry portion 44*a* of guide track 44 then guides the wire back into winding channel 224 for winding of the remaining conductor turns of winding unit 24. Thus, depending on the direction of the oblique angle an entry portion 44*a* forms with the transverse direction, the conductor wire may either enter a subsequent winding unit winding channel for winding of subsequent conductor turns or may re-enter the same winding channel for continued winding of a given winding unit conductor turns.

With the winding structure embodying the invention, as described, automatic winding of a plurality of winding units may be performed without the necessity of stopping the winding operation for performing the termination procedures for the start, finish, and tap locations of each winding unit. All the winding units may be wound in a single continuous automatic winding operation beginning with the start location of the first winding unit and continuing through the finish location of the last winding unit, as will now be explained illustratively for the four winding units of FIG. 1. Such explanation is provided with reference to FIGS. 6–8, illustrating various cross-sections and face views of an unwound outer bobbin 35 of primary assembly 32 of FIG. 2. The longitudinal connecting conductors and certain identifying numerals and letters have been omitted for greater clarity.

To commence the winding operation, several turns of conductor wire emergent from the flyer head of the coil winding machine are wrapped around the "L" shaped portion of longitudinal connecting conductors 122*s* protruding beyond end wall 41 of FIG. 2. These wrapped turns in effect form the start location conductor portion 22*s* of the first winding unit 22. The flyer head then begins to revolve about the central axis 37 clockwise in the direction of arrow 46 when observed from the vantage view illustrated in FIG. 3. To reach winding channel 222 from the start location 22*s*, an initial guide track entry portion 44*c* is formed in end wall 41, as illustrated in the face view of outer bobbin 35 in FIG. 6*b*, along the viewing axis 47 in the vicinity of the cross-sectional plane of FIG. 6*a*.

As the flyer revolves and reaches the location of the guide track entry portion 44*c* in end wall 41, it also begins indexing or traveling in the longitudinal direction, thereby emplacing conductor wire in the guide track entry portion. Upon reaching winding channel 222, the flyer continues indexing and revolving at various predetermined rates, thereby emplacing the conductor turns of winding unit 22 in the winding channel 222.

After the required number of conductor turns have been wound, the flyer will have reached the guide track exit portion 44*b* in partition 38 of FIG. 6*b*. By appropriate indexing and revolving, the flyer then emplaces the finish location conductor portion 22*f* of winding unit 22 over its associated passageway 422*f*.

Continuing to revolve, the flyer will also emplace conductor wire over passageway 423*s*, thereby emplacing the start location 23*s* of the next winding unit 23, as illustrated in FIG. 6*c*, the face view along viewing axis 48. After emplacing start location 23*s* over passageway 423*s*, the flyer reaches guide track entry portion 44*a*, emplaces the conductor wire, and enters the next winding channel 223 to begin winding the conductor turns of winding unit 223.

In such a manner as described, emplacement and winding of all the winding units 22–25 are accomplished. FIG. 7*a* illustrates the cross-sectional view of the outer bobbin 35 of FIG. 2 in the plane 7*a*. FIGS. 7*b* and 7*c* illustrate face views along the viewing axes 49 and 50 in the vicinity of plane 7*a* exemplifying the construction of the guide tracks and passageways associated with the finish location 23*f* of winding unit 23 and the start location 24*s* of winding unit 24. Similarly, FIG. 8*a* illustrates the cross-sectional view of the outer bobbin 35 of FIG. 2 in the plane 8*a*, and FIGS. 8*b*–8*f* illustrate face views along the viewing axes 51–55 in the vicinity of plane 8*a*. With reference to FIG. 8*c*, it should be noted that to accomplish emplacement of a tap location conductor portion or termination segment, such as tap location 24*t* of winding unit 424 over passageway 424*t*, both the exit portion 44*b* and the entry portion 44*a* of guide track 44 are located at generally opposite sides of passageway 424*t* and are connected to the same winding channel 224. Thus, after emplacement of the tap location 24*t*, the remaining conductor turns of winding unit 24 can be wound in the same winding channel.

After completion of the winding of the last conductor turn of the last winding unit 25, the finish location conductor portion 25*f* is emplaced by the flyer over passageway 425*f*, as illustrated in FIG. 8*b*. The final exit portion 44*d* of guide track 44 returns the conductor wire back to winding channel 225. The side walls of exit portion 44*d* are tapered sufficiently to snugly wedge the conductor wire of finish location conductor portion 25*f* into the guide track. When the wire from the flyer spool is cut, the winding operation is completed.

Figure 5:
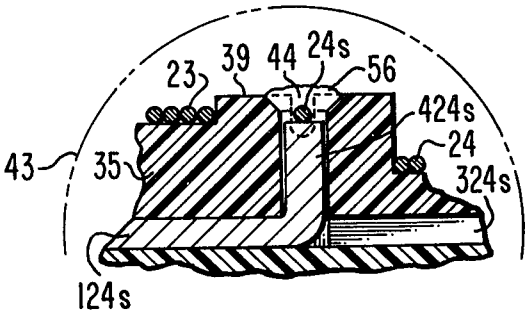
FIG. 5 illustrates an enlarged view of an area encircled in FIG. 4.

After the end of winding termination procedure is performed, the conductor wire of the start, finish, and tap locations of the winding units are soldered to the radial extensions of the associated longitudinal connecting conductors, thereby ensuring good electrical connection. As illustrated in FIGS. 5 and 9 for a selected exemplification, passageway 424*s* is made of square cross-section to accommodate the radial extension of the square cross-sectioned longitudinal connecting conductor 124*s*. The conductor wire 36 forming the start location conductor portion 24*s* may be of solderable wire and is located in guide track 44 over the radial extension of connecting conductor 124*s*. As illustrated in FIGS. 5 and 9, a solder material 56 is placed in the upper portion of passageway 424*s*. The upper portion of the passageway is chamfered or outwardly flared to permit easy access of the solder into the passageway.

Alternatively, instead of providing a radial extension to longitudinal connecting conductor 124*s* as illustrated in FIG. 4, the connecting conductor may be extended longitudinally in groove 324*s* beyond passageway 424*s*. A solderable slug or cylinder is then inserted in passageway 424 to provide electrical interconnection between longitudinal connecting conductor 124*s* and its associating winding unit conductor termination segment 24*s*. Resistance welding or other heating techniques may be used instead of soldering.

It should be noted that although the winding and termination procedure was above-described with a wire guidance system using a revolving flyer head, similar procedure would be involved using instead a rotating bobbin to emplace the conductor wire.

As described previously, all four winding units are wound over outer bobbin 35 in one continuous operation with a single continuous wire being played out from the flyer. To create distinct winding units after the winding and soldering operation is completed, a cutting tool is used with cutting heads arranged over each of the cutting slits 45 in the guide tracks 44 in each of the partitions 38–40. The cutting heads are pressed into the conductor wire overlaying the cutting slits 45, thereby separating the wire at each slit location, and forming the intermediate start and finish locations 23*s*–25*s* and 22*f*–24*f*, and creating the four separate winding units 22–25.

With the above-described winding structure and winding method, great flexibility is provided in angularly and longitudinally locating start, finish, and tap location conductor portions. As illustrated in FIG. 2, the finish location 25*f* of the fourth winding unit 25 may be angularly positioned between the start location 24*s* of the third winding unit 24 and the finish location 23*f* of the second winding unit 23. Whereas, the longitudinal position of finish location 25 is in partition 40 separating the winding channels 224 and 225 of the third and fourth winding units 24 and 25.

All the electrical connections of the start, finish, and tap locations of the winding units with the other television receiver circuits are provided at one end of the bobbin by means of the longitudinal connecting conductors, thereby facilitating insertion of the transformer into a printed circuit board. The start, finish, and tap location conductor portions, however, may be located at various angular and longitudinal positions along the bobbin, yet not requiring these portions to be pulled to the end of the bobbin.

Extra longitudinal connecting conductors not connected to any of the winding units 22–25, such as connecting conductors 127 and 128, may be provided. These connecting conductors provide convenient electrical connection capabilities, not illustrated, with other circuits and windings associated with primary assembly 32.

High voltage assembly 33, illustrated in FIG. 10, may conventionally comprise a hollow cylindrical high voltage bobbin 68 with a longitudinal axis in common with central axis 37. At different longitudinal positions along the central axis 37 are located six grooves 61*a*–61*f* into which are wound in a conventional manner the high voltage winding units 26*a*–26*f*. Omitted from illustration are the diodes 60–62, the ultor terminal 63, and the interconnections between them.

The high voltage assembly 33 is slipped over primary assembly 32. By providing a key 64 in high voltage bobbin 68 of high voltage assembly 33, illustrated in FIG. 10, and a corresponding keyway 31 in the outer bobbin 35 of primary assembly 32, illustrated in FIGS. 3 and 4, proper relative orientation and longitudinal positioning of the two assemblies are maintained.

After high voltage assembly 33 is placed over primary assembly 32 to form a transformer arrangement, two "C" shaped ferrite core pieces with vertical center legs of rectangular cross-section are inserted in the hollow interior portion of inner bobbin 34. Each core piece is inserted through an end of the transformer. Open vertical sections 70*a* and 70*b* are formed in the ends of inner bobbin 34, as illustrated in FIGS. 3 and 4. The vertical center legs of the "C" shaped core pieces are lodged in the openings 70*a* and 70*b* and prevent rotation of the core pieces. To provide proper orientation of the core pieces relative to the primary and high voltage assembly, a key 30 in inner bobbin 34 and a corresponding keyway 29 in outer bobbin 35 are formed.

What is claimed is:

1. A winding structure comprising:

a bobbin;

at least a first winding channel situated adjacent an outer surface of said bobbin, at least a first conductor winding unit about said first winding channel, said first winding unit including at least a first conductor termination segment located at a first predetermined longitudinal position along a longitudinal axis of said bobbin and at a first predetermined angular position about said longitudinal axis;

at least a first longitudinal connecting conductor located inwardly of said outer surface and traversing at least a portion of said bobbin in a direction generally along said longitudinal axis;

a winding channel shoulder located in the vicinity of said first predetermined longitudinal position;

at least a first passageway located in said shoulder adjacent said first predetermined angular position providing access to said first longitudinal connecting conductor;

at least one guide track located in said shoulder connecting said first passageway to said first winding channel guiding a conductor portion of said first winding unit from said first winding channel to said passageway for emplacing said first conductor termination segment; and first electrical interconnecting means located in said first passageway providing electrical connection between said first conductor termination segment and said first longitudinal connecting conductor.

2. A structure according to claim 1, wherein said guide track includes a first oblique portion connecting said first winding channel to said first passageway.

3. A structure according to claim 2, including a second winding channel with at least a second winding unit, said shoulder separating said first and second winding channels.

4. A structure according to claim 3, wherein a second conductor termination segment of said second winding unit is located adjacent said first predetermined longitudinal position and at a second predetermined angular position.

5. A structure according to claim 4, including a second longitudinal connecting conductor and a second passageway located in said shoulder adjacent said second predetermined angular position providing access to said second longitudinal connecting conductor.

6. A structure according to claim 5, wherein said guide track includes a second oblique portion connecting said second winding channel to said second passageway.

7. A structure according to claim 6, wherein said interconnection means comprises a radial extension of said first longitudinal connecting conductor.

8. A structure according to claim 6, wherein said first conductor termination segment comprises a finish location conductor portion of said first winding unit and said second conductor termination segment comprises a start location conductor portion of said second winding unit.

9. A structure according to claim 8, wherein said guide track includes a third portion connecting said first and second passageways, a cutting slot being formed in said third portion.

10. A structure according to claim 1, wherein said guide track includes first and second oblique portions, each oblique portion at generally opposite sides of said first passageway, each oblique portion connecting said first passageway to said first winding channel emplacing said first conductor termination segment as a tap location conductor portion of said first winding channel.

11. A winding structure comprising:

a bobbin;

a plurality of winding channels situated adjacent an outer surface of said bobbin, a plurality of conductor winding units about said winding channels, said winding units including start and finish location conductor portions located at predetermined longitudinal positions along a longitudinal axis of said bobbin and at predetermined angular positions about said longitudinal axis;

a plurality of longitudinal connecting conductors located inwardly of said outer surface and traversing at least a portion of said bobbin in a direction generally along said longitudinal axis;

at least one partition located in the vicinity of one of said predetermined longitudinal positions for separating adjacent winding channels;

a plurality of passageways located in said partition adjacent at least one of said predetermined angular positions for providing access to said longitudinal connecting conductors;

at least one guide track located in said partition connecting at least one of said passageways to at least one of said winding channels guiding a conductor portion of a winding unit from a winding channel to a passageway for emplacing a start or finish location conductor portion; and electrical interconnecting means located in said passageway providing electrical connection between a start or finish location conductor portion and a longitudinal connecting conductor.

* * * * *